US007021391B2

(12) United States Patent
Schasteen

(10) Patent No.: US 7,021,391 B2
(45) Date of Patent: Apr. 4, 2006

(54) PORTABLE FIRE FIGHTING SYSTEM AND EXTINGUISHER APPARATUS AND METHOD

(76) Inventor: Thomas C. Schasteen, 12008 Bliss Cochran Rd., Gig Harbor, WA (US) 98329

( * ) Notice: Subject to any disclaimer, the term of this patent is extended or adjusted under 35 U.S.C. 154(b) by 0 days.

(21) Appl. No.: 10/835,947

(22) Filed: Apr. 30, 2004

(65) Prior Publication Data

US 2004/0221998 A1 Nov. 11, 2004

Related U.S. Application Data

(60) Provisional application No. 60/468,422, filed on May 7, 2003.

(51) Int. Cl.
*A62C 35/00* (2006.01)

(52) U.S. Cl. ..... 169/14; 169/15; 169/30; 169/74; 169/91; 169/46; 239/289; 239/351; 239/307; 239/369

(58) Field of Classification Search ..... 169/30, 169/71, 74, 91, 14, 15; 239/351, 355, 366, 239/368, 369, 372, 289, 152, 153, 154; 406/38, 406/98; 15/328
See application file for complete search history.

(56) References Cited

U.S. PATENT DOCUMENTS

| | | | | |
|---|---|---|---|---|
| 1,986,407 | A * | 1/1935 | Parker | 239/77 |
| 2,275,691 | A * | 3/1942 | Simanton | 239/425 |
| 3,421,697 | A * | 1/1969 | Marks | 239/152 |
| 3,424,250 | A * | 1/1969 | Thomae | 169/15 |
| 4,011,911 | A | 3/1977 | Gow | |
| 4,254,883 | A | 3/1981 | Perry | |
| 4,359,096 | A | 11/1982 | Berger | |
| 4,620,598 | A | 11/1986 | Reeder | |
| 4,862,968 | A | 9/1989 | Woodman | |
| 5,409,067 | A | 4/1995 | Esposito et al. | |
| 5,947,384 | A * | 9/1999 | McCauley | 239/152 |
| 6,527,058 | B1 | 3/2003 | Nerat | |
| 2001/0004938 | A1 | 6/2001 | McSheffrey et al. | |
| 2002/0040789 | A1 | 4/2002 | Neumeir et al. | |

OTHER PUBLICATIONS

Publication by: Firematic Manufacturing re: PORTACAFS (product information).
*Publication Title: Power Blowers as Fireline Building Tools* Pub. Date: Dec., 1993 by Roscommon Equipment Center Program.

* cited by examiner

*Primary Examiner*—Dinh Q Nguyen
(74) *Attorney, Agent, or Firm*—William Forster

(57) ABSTRACT

A portable fire extinguisher comprising a blower tube assembly that includes an outer tube with an inner mixing chamber disposed "upstream" from an adjacent outlet port that provides a passage to direct a discharge flow of mixed air and fire retardant out of the outer tube to extinguish a fire. The inner mixing chamber is adapted for communication with a portable reservoir containing a liquid fire retardant which is enabled to flow into the inner mixing chamber. The blower tube assembly further includes an inner tube that defines a blower tube inlet port adapted to receive the outlet port of a portable forced air blower. The inner tube is disposed for communication with the inner mixing chamber of the outer tube to enable a continuous volume of forced air to flow from a portable forced air blower, through the inner tube and into the inner mixing chamber of the outer tube. At least one ambient air intake port is provided for communication with the inner mixing chamber to enable ambient air to enter the inner mixing chamber and mix with a flow of forced air and fire retardant for discharge through the outlet port of the outer tube.

17 Claims, 3 Drawing Sheets

PORTABLE FIRE FIGHTING SYSTEM AND EXTINGUISHER APPARATUS AND METHOD

This application claims the benefit of U.S. Provisional Application No. 60/468,422 filed May 7, 2003.

BACKGROUND

This invention relates generally fire fighting equipment, and more particularly to portable fire extinguishers that employ and apply liquid fire retardants to fires to extinguish the same.

Portable fire fighting systems are well known in the art. Such systems and tools vary widely in complexity, ease of operation and cost of manufacturing. For example, one early design is disclosed in U.S. Pat. No. 4,011,911 issued to Gow in 1977 showing a portable fire extinguisher that operates on centrifugal force. Although this design is portable, it is complex and is not designed to be held by the user while it is in use.

In 1981 U.S. Pat. No. 4,254,833 issued to Perry disclosing a portable fire extinguisher composed of a portable air tank with a pressure regulator and a liquid carrying tank containing the fire extinguishing liquid. Although this arrangement is readily portable, it lacks the capability of a high volume of gas to distribute the extinguishing liquid.

In 1982, U.S. Pat. No. 4,359,096 issued directed to an aqueous film-forming foam fire extinguisher arranged similar to a traditional fire extinguisher that comprises a fixed amount of pressurized medium to propel on to a fire. Similarly, in 1986 and 1989 U.S. Pat. Nos. 4,620,598 and 4,862,968 issued showing a disposable fire extinguisher that employs a fire extinguishing medium which is discharged under pressure.

In 1995, U.S. Pat. No. 5,409,067 issued illustrating a portable fire fighting tool that is connectable to a portable fire extinguisher that like those noted above that operate under pressure to apply a fire extinguishing medium.

Other more recently disclosed portable fire extinguishers include U.S. Pat. No. 6,527,058 issued in 2003, U.S. Publications U.S. 2001/0004938 A1 and U.S. 2002/0040789 A1, each operate by discharging a fire extinguishing medium which is under pressure.

While most of the above noted designs can be employed to effectively extinguish a fire, they are, for the most part, complex in their construction, costly to manufacture, and bulky thereby inhibiting portability. In addition, because of the diversity of specialized components found in the above noted fire fighting devices, it would be difficult to stock replacement parts for repair.

Accordingly, a need remains for a safe, effective, inexpensive fire extinguisher system and tool that is constructed to include common, readily available components that can be quickly replaced or repaired.

SUMMARY OF THE INVENTION

One object of the present invention is to enable a fire fighter to easily carry a portable fire extinguisher to remote areas where fires need to be extinguished.

A second object is to reduce the time required to extinguish a fire thereby increasing the efficiency of extinguishing fires.

Another object is to reduce the expense of outfitting a firefighter to extinguish fires.

Yet another object is to increase the availability of simple, reliable fire extinguishing equipment and components.

A further object is to increase the safety of fire fighters that are in the process of fighting fires.

Still another object is to incorporate readily obtainable, off-the-shelf equipment and tools in a fire extinguishing system to reduce the costs thereof, and to increase the availability of an effective fire fighting and extinguishing tool.

The invention is a portable fire extinguisher comprising a blower tube assembly. Specifically, the blower tube assembly includes an outer tube that is constructed to define an inner mixing chamber disposed "upstream" from an adjacent outlet port. Importantly, the outlet port provides a passage to direct a discharge flow of mixed air and fire retardant out of the outer tube, and therefore out the blower tube assembly to extinguish a fire. For this purpose, the inner mixing chamber is adapted for communication with a portable reservoir containing a liquid fire retardant which is enabled to flow into the inner mixing chamber.

Further, the blower tube assembly includes an inner tube that defines a blower tube inlet port constructed and adapted to receive the outlet port of a common "hand held" type portable forced air blower. In this way, the inner tube can be fixed relative to the outer tube, disposed for communication with the inner mixing chamber of the outer tube to enable a continuous volume of forced air to flow from a portable forced air blower, through the inner tube and into the inner mixing chamber of the outer tube.

Also included in the blower tube assembly, is at least one ambient air intake port disposed for communication with the inner mixing chamber. This construction enables ambient air, surrounding the outside of the outer tube, to enter into the inner mixing chamber and mix with a flow of forced air and fire retardant for discharge through the outlet port of the outer tube. Accordingly, the ambient air mixing with the forced air increases the complete mixture and dispersion of the liquid fire retardant therewith so that a user can direct the same to extinguish a fire.

In another aspect of the invention, the portable fire extinguisher further comprises at least one spacer support disposed between the outer tube and the inner tube so that the relative position of outer tube from the inner tube is substantially fixed, and wherein the ambient air intake port is defined by a passage formed between the outer tube and the inner tube, adjacent the spacer support.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

DETAILED DESCRIPTION OF PREFERRED EMBODIMENTS

Figure 1:
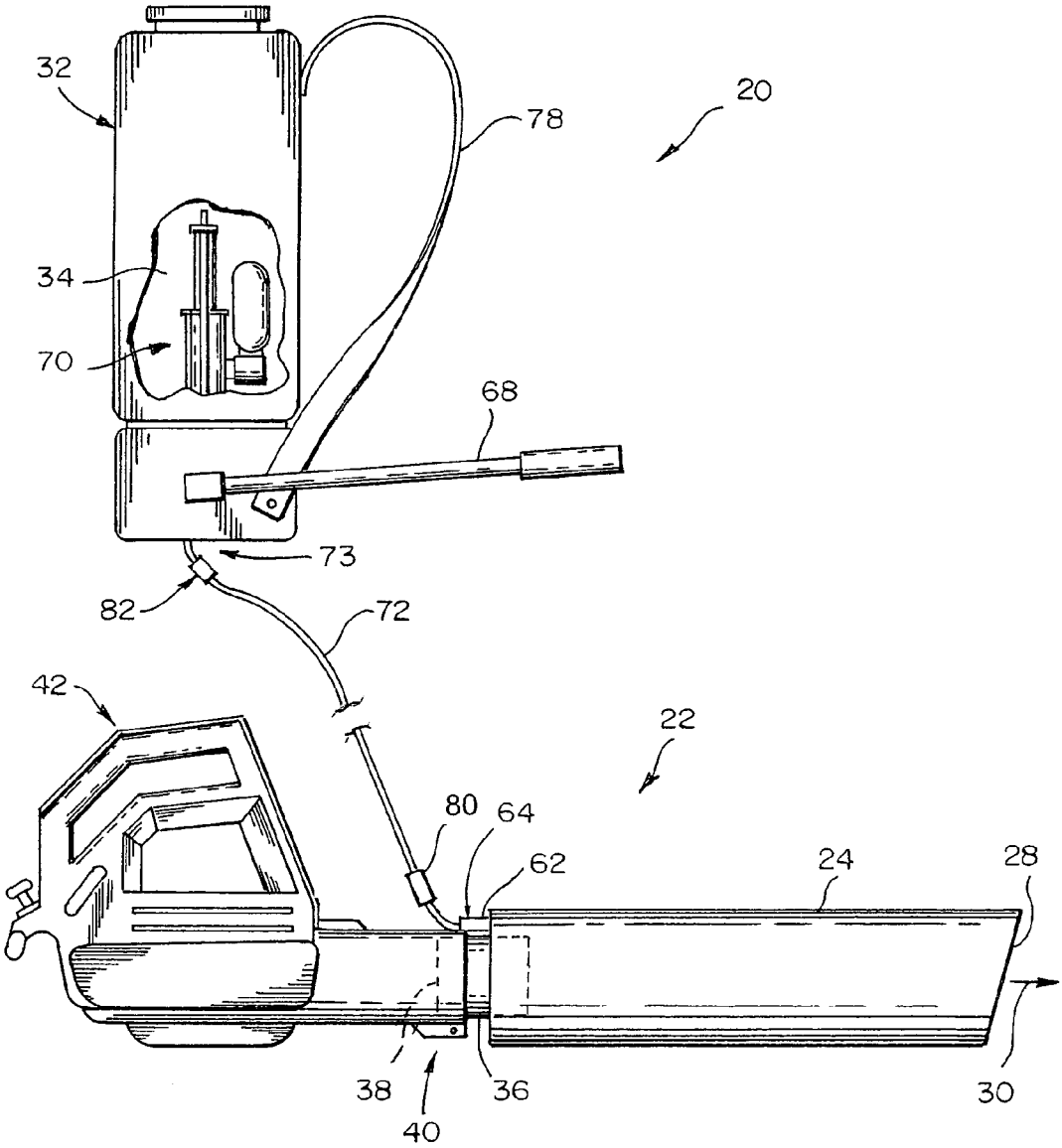
FIG. 1 is a perspective view of the preferred embodiment of a portable fire fighting system/extinguisher, showing component parts thereof.
Figure 2:
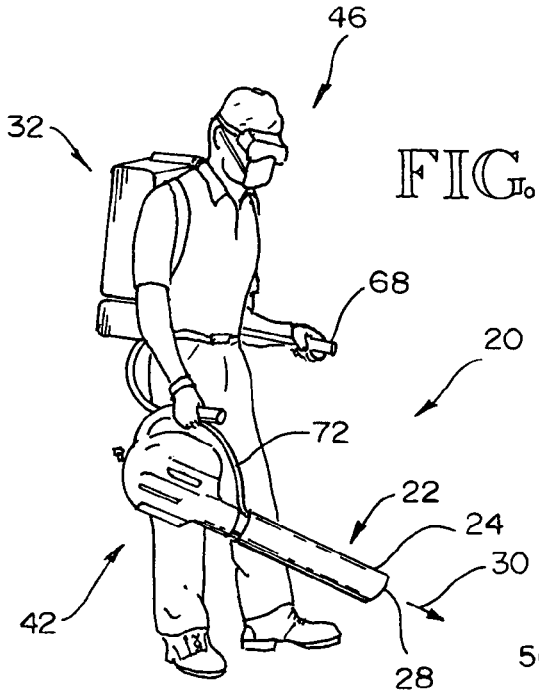
FIG. 2 is a perspective view of a portable fire extinguisher showing the fire extinguishing system employed by a fire fighter.
Figure 4:
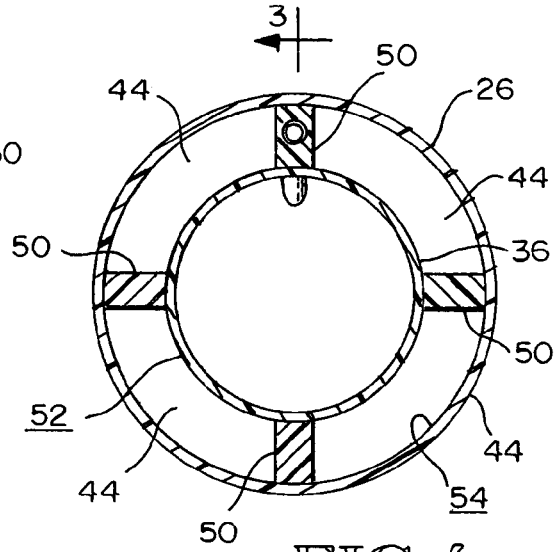
FIG. 4 is a section taken along 4—4 in FIG. 3 illustrating a cylindrical inner tube received within a larger diameter cylindrical outer tube, wherein a plurality of spacer supports are disposed between the inner tube and the outer tube, and wherein a portion of each spacer support is fixed the inner tube and the outer tube thereby restricting relative movement between the inner tube and the outer tube.

FIGS. 1 through 5 show the present invention portable fire fighting system and portable fire extinguisher 20. Primarily, the portable fire extinguisher comprises a blower tube assembly 22. Specifically, the blower tube assembly 22 includes an outer tube 24 that is constructed to define an inner mixing chamber 26 disposed "upstream" from an adjacent outlet port 28. Importantly, and as will be discussed more fully in the following, the outlet port 28 provides a passage to direct a discharge flow 30 of mixed air and fire retardant out of the outer tube 24, and therefore out the blower tube assembly 22 to extinguish a fire (not illustrated). For this purpose, the inner mixing chamber 26 is adapted for communication with a portable reservoir 32 containing a liquid fire retardant 34 which is enabled to flow into the inner mixing chamber 26. It should of fire suppressant including water.

Further, the blower tube assembly 22 includes an inner tube 36 that defines a blower tube inlet port 38 constructed and adapted to receive the outlet port 40 of a common "hand held" type portable forced air blower 42. In this way, the inner tube 36 can be fixed relative to the outer tube 24, disposed for communication with the inner mixing chamber 26 of the outer tube 24 to enable a continuous volume of forced air to flow from a portable forced air blower 42, through the inner tube 36 and into the inner mixing chamber 26 of the outer tube 24.

Also included in the blower tube assembly 22, is at least one ambient air intake port 44 disposed for communication with the inner mixing chamber 26. This construction enables ambient air, surrounding the outside of the outer tube 24, to enter into the inner mixing chamber 26 and mix with a flow of forced air and liquid fire retardant 34 for discharge through the outlet port 28 of the outer tube 24. Accordingly, the ambient air mixing with the forced air increases the complete mixture and dispersion of the liquid fire retardant 34 therewith so that a user 46 can direct the same to extinguish a fire.

Figure 5:
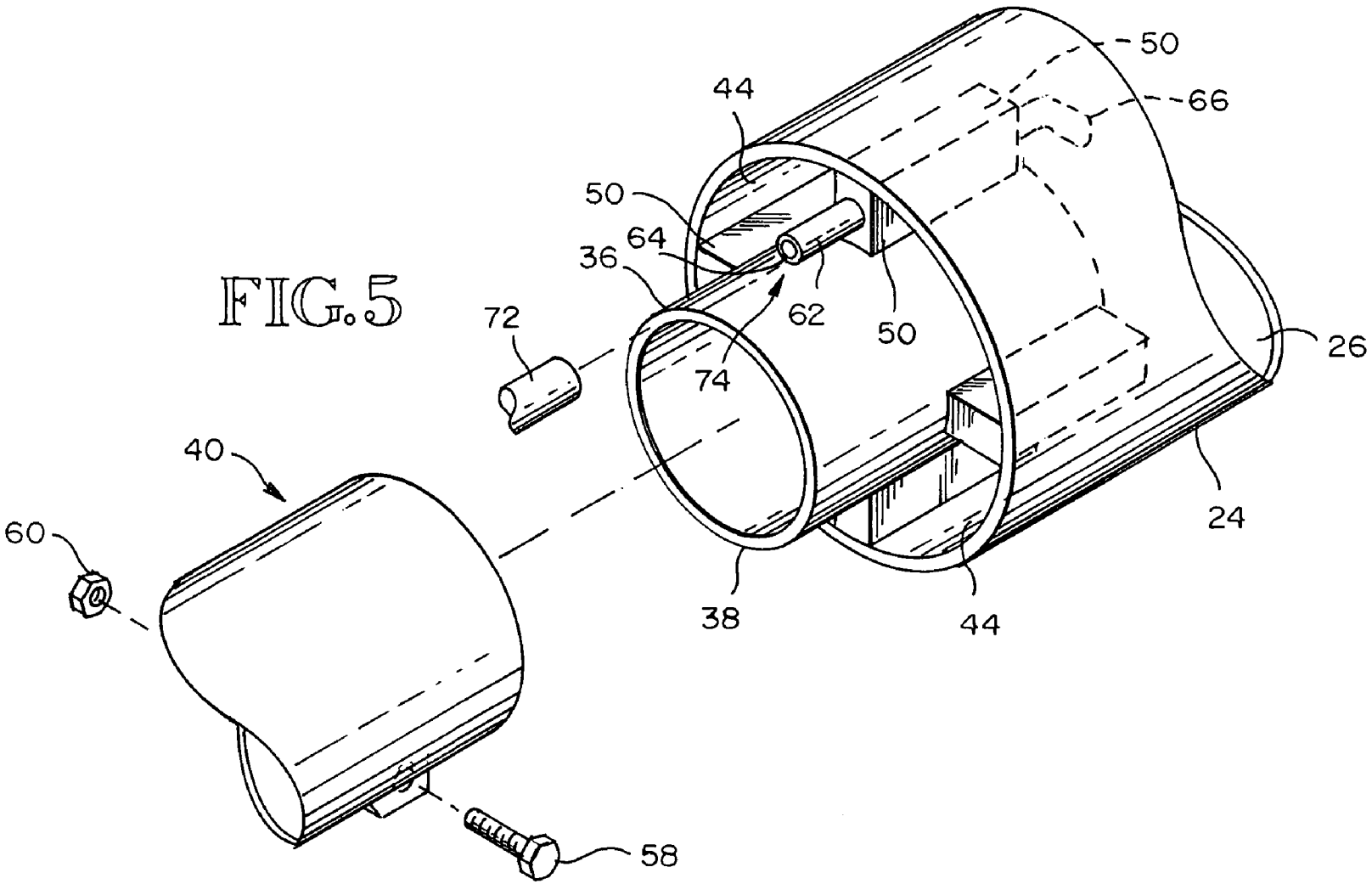
FIG. 5 is a partial exploded perspective view with portions broken away to illustrate the outlet port of a portable forced air blower being guided for connection to the blower tube inlet port defined by the inner tube of a blower tube assembly.

Considering now in more detail the structure of the components from which a fire extinguisher 20 is constructed, in the present invention, at least one spacer support 50 is provided for placement between the outer tube 24, and the inner tube 36 as best illustrated in FIG. 5. However, a preferred embodiment includes a plurality of alike spacer supports 50 that extend radially outward from the radially outer surface 52 of the inner tube 36 to the radially inner surface 54 of the outer tube 24. Accordingly, in the preferred embodiment, the inner tube is 36 is cylindrical in shape, with a diameter smaller than that of a cylindrically shaped outer tube 24.

In this way, the inner tube 36 fits within the outer tube 24 so that a plurality of spacer supports 50 can be disposed as illustrated in FIG. 5, thereby fixing the relative position of outer tube 24 from the inner tube 36. With this construction, a plurality of ambient air intake ports 44 are defined by the plurality of passages formed between the outer tube 24 and the inner tube 36, as defined by the adjacent spacer supports 50.

It should be under stood that the inner tube 36 can be fixedly attached to the outer tube 24, via spacer supports 50 that incorporate connections by welds, adhesives, screws, rivets, or any other means that will provide a secure connection. In addition, the inner tube 36 and outer tube 24 are conceivably comprised of plastic, metal, fiberglass, or any other similar material.

Turning again to FIG. 3, a typical hand held portable forced air blower 42 includes an outlet port 40. Accordingly, the blower tube inlet port 38 is sized to permit the blower's outlet port 40 to be slidably attached to the blower tube inlet port 38 of the portable forced air blower 42. For this purpose, an ideal forced air blower 42 incorporates an adjustable band portion 56 in the outlet port 40 that incorporates a bolt 58 with an opposing nut 60 to tighten the same around the blower tube inlet port 38.

Moreover, the above noted slidable attachment may be accomplished in many other ways (not illustrated) such that the outlet port 40, of the blower, remains fixed and stationary during use of the portable fire fighting system/extinguisher, and to allow removal of the blower tube inlet port 38 from the forced air blower 42 if desired when the system is not in use.

Turning again to FIG. 3, the preferred embodiment further comprises a flow nozzle 62 that extends through the outer tube 24 of the blower tube assembly 22, wherein the flow nozzle 62 includes a first end 64 disposed on the outside of the blower tube assembly 22 for connection to a portable reservoir 32, and a second end 66 disposed within the inner mixing chamber 26 so that liquid fire retardant 34 can flow from the portable reservoir 32, through the flow nozzle 62, into the inner mixing chamber 26. As can be seen, the flow nozzle 62 is a hollow tube which could be made of any rigid material capable of maintaining it desired position within the inner mixing chamber 26.

Figure 3:
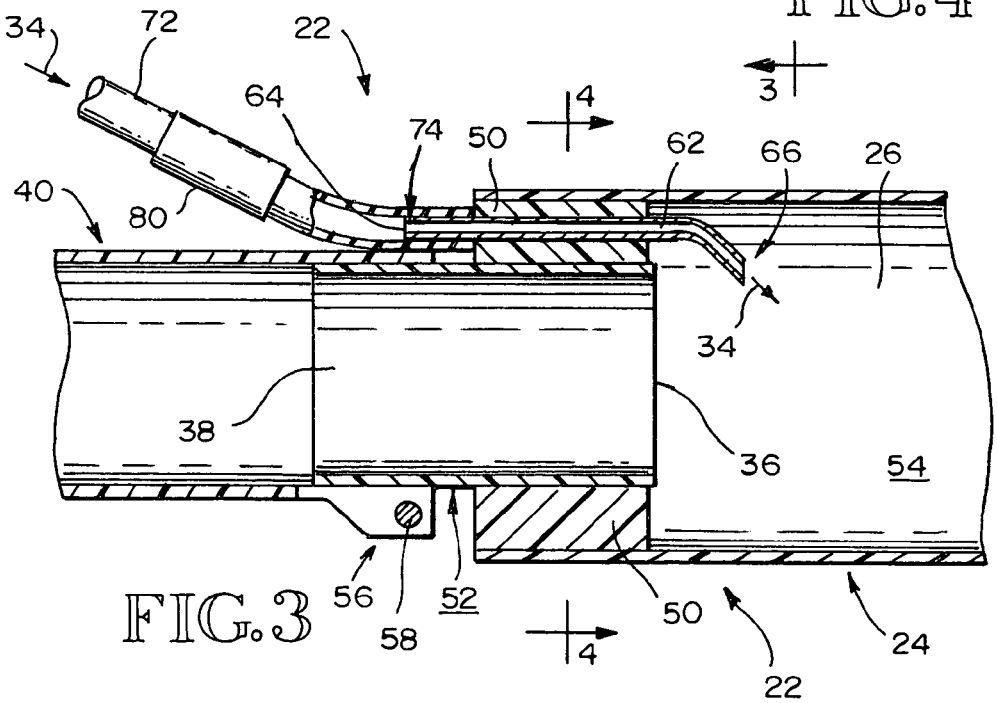
FIG. 3 is a sectional view taken along 3—3 of FIG. 4 to show of a portable fire extinguisher with portions broken away illustrating the outlet port of a forced air blower connected to the inlet port of a blower tube assembly, with related features of the present invention also shown.

Beyond this, the flow nozzle 62, in the present invention is disposed through a spacer support 50, from outside the outer tube 24 to inside the inner mixing chamber 26 as best illustrated in FIGS. 3 and 5. This construction helps to maintain the flow nozzle 62 in proper position.

Returning now to FIG. 1, it should be noted that a preferred embodiment blower tube assembly 22 can be fitted to many types of hand-held portable forced air blowers, including leaf blowing machines. Such blowers could be powered by a motor driven impeller-type air blowing device, conceivably powered by gasoline, electricity, battery, or any other appropriate energy source. All that is required is a blower having an outlet port 40 sized to be connected to the blower tube inlet port 38.

Similarly, the portable reservoir 32 is a common backpack style sprayer having a pump handle 68 that operates an internal pump 70, to produce a flow of liquid, i.e., liquid fire retardant 34 though a connecting tube 72 that leads from the reservoir tank outlet 73, down to the inlet port 74 of the flow nozzle 62 as illustrated in FIG. 3.

A portable reservoir 32 as described above typically employs straps 78 to secure the portable reservoir 32 to the user's back. Further, a portable reservoir 32 could include a connecting tube 72 that includes a quick disconnect fitting 80 to enable the user to easily separate the blower tube assembly 22 from the portable reservoir 32.

Another feature, that could be included is an on/off valve 82 disposed in or along the connecting tube 72 to allow the user to stop the flow of fire retardant 34 to preserve the same.

In operation the user or fire fighter proceeds to engage in fire fighting activity, directing the outlet port 28 of the blower tube assembly 22 in the direction of the fire or flame that the fire fighter is attempting to retard or extinguish. The flow of air from the outlet port 40 of the portable forced air blower 42, into the blower tube inlet port 38 of the outer tube 24 creates a Venturi effect, or vacuum, that causes air to be drawn into inner mixing chamber 26 from the ambient air intake ports 44.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A portable fire extinguisher comprising:

a blower tube assembly having:

an outer tube that defines an inner mixing chamber disposed adjacent to an outlet port adapted to direct a discharge flow of a mixed air and fire retardant out of the outer tube to extinguish a fire, wherein the inner mixing chamber is adapted for communication with a portable reservoir containing a liquid fire retardant which is enabled to flow into the inner mixing chamber;

an inner tube defining a blower tube inlet port adapted to receive the outlet port of a portable forced air blower, wherein the inner tube is disposed for communication with the inner mixing chamber to enable a continuous volume of forced air to flow from a portable forced air blower, through the inner tube into the inner mixing chamber of the outer tube;

at least one ambient air intake port disposed for communication with the inner mixing chamber to channel ambient air, disposed outside the outer tube, to enter into the inner mixing chamber to mix with a flow of forced air and fire retardant for discharge through the outlet port of the outer tube;

at least one spacer support disposed between the outer tube and the inner tube so that the relative position of outer tube from the inner tube is substantially fixed, and wherein the ambient air intake port is defined by a passage formed between the outer tube and the inner tube, adjacent the spacer support.

2. A portable fire extinguisher as recited in claim 1 wherein an outer portion of said spacer support is fixed to the outer tube, and an opposing inner portion of said spacer support is fixed to inner tube thereby fixing the inner tube to the outer tube such that relative movement between the inner tube and the outer tube is restricted.

3. A portable fire extinguisher as recited in claim 1 wherein a plurality of spacer supports are employed to fix the inner tube in relation to the outer tube to restrict relative movement, and wherein a plurality of ambient air intake ports are defined by said plurality of spacer supports.

4. A portable fire extinguisher as recited in claim 1 wherein the outer tube is cylindrical in shape and larger in diameter that a cylindrically shaped inner tube, wherein a portion of the outer tube is disposed over the inner tube to form a passage that defines the ambient air intake port.

5. A portable fire extinguisher as recited in claim 4 wherein a plurality of support spacers are radially disposed around the inner tube, extending radially outward from the inner tube to the outer tube to form a plurality of alike ambient air intake ports.

6. A portable fire extinguisher as recited in claim 5 wherein each support spacer includes an outer portion fixed to the outer tube, and an opposing inner portion fixed to the inner tube thereby fixing the inner tube to the outer tube such that relative movement between the inner tube and the outer tube is restricted.

7. A portable fire extinguisher comprising:

a blower tube assembly having:

an outer tube that defines an inner mixing chamber disposed adjacent to an outlet port adapted to direct a discharge flow of a mixed air and fire retardant out of the outer tube to extinguish a fire, wherein the inner mixing chamber is adapted for communication with a portable reservoir containing a liquid fire retardant which is enabled to flow into the inner mixing chamber;

an inner tube defining a blower tube inlet port adapted to receive the outlet port of a portable forced air blower, wherein the inner tube is disposed for communication with the inner mixing chamber to enable a continuous volume of forced air to flow from a portable forced air blower, through the inner tube into the inner mixing chamber of the outer tube;

at least one ambient air intake port disposed for communication with the inner mixing chamber to enable ambient air, disposed outside the outer tube, to enter into the inner mixing chamber to mix with a flow of forced air and fire retardant for discharge through the outlet port of the outer tube; and a flow nozzle extending through the outer tube of the blower tube assembly, wherein the flow nozzle includes a first end disposed on the outside of the blower tube assembly for connection to a portable reservoir, and a second end disposed within the inner mixing chamber so that liquid fire retardant can flow from the portable reservoir, through the flow nozzle into the inner mixing chamber.

8. A portable fire extinguisher as recited in claim 7 wherein the flow nozzle is disposed to extend through the outer tube, and through a support spacer, into the inner mixing chamber.

9. A method of making a portable fire extinguisher comprising the steps:

assembling a blower tube assembly including:

providing an outer tube that defines an inner mixing chamber disposed adjacent to an outlet port adapted to direct a discharge flow of a mixed air and fire retardant out of the outer tube to extinguish a fire, wherein the inner mixing chamber is adapted for communication with a portable reservoir containing a liquid fire retardant which is enabled to flow into the inner mixing chamber;

providing an inner tube that defines a blower tube inlet port adapted to receive the outlet port of a portable forced air blower, wherein the inner tube is disposed for communication with the inner mixing chamber to enable a continuous volume of forced air to flow from a portable forced air blower, through the inner tube into the inner mixing chamber of the outer tube;

forming at least one ambient air intake port disposed for communication with the inner mixing chamber to channel ambient air, disposed outside the outer tube, to enter into the inner mixing chamber to mix with a flow of forced air and fire retardant for discharge through the outlet port of the outer tube;

providing at least one spacer support disposed between the outer tube and the inner tube so that the relative position of outer tube from the inner tube is substantially fixed, and wherein the ambient air intake port is formed by a passage formed between the outer tube and the inner tube, adjacent the spacer support.

10. A method of making a portable fire extinguisher as recited in claim 9 wherein a plurality of spacer supports are employed to fix the inner tube in relation to the outer tube to restrict relative movement, and wherein a plurality of ambient air intake ports are defined and formed by said plurality of spacer supports.

11. A method of making a portable fire extinguisher as recited in claim 9 wherein the outer tube is cylindrical in shape and larger in diameter that a cylindrically shaped inner tube, wherein a portion of the outer tube is disposed over the inner tube to form a passage that defines the ambient air intake port.

12. A method of making a portable fire extinguisher as recited in claim 11 wherein a plurality of support spacers are radially disposed around the inner tube, extending radially outward from the inner tube to the outer tube to form a plurality of alike ambient air intake ports.

13. A method of making a portable fire extinguisher comprising the steps:

assembling a blower tube assembly including:

providing an outer tube that defines an inner mixing chamber disposed adjacent to an outlet port adapted to direct a discharge flow of a mixed air and fire retardant out of the outer tube to extinguish a fire, wherein the inner mixing chamber is adapted for communication with a portable reservoir containing a liquid fire retardant which is enabled to flow into the inner mixing chamber;

providing an inner tube that defines a blower tube inlet port adapted to receive the outlet port of a portable forced air blower, wherein the inner tube is disposed for communication with the inner mixing chamber to enable a continuous volume of forced air to flow from a portable forced air blower, through the inner tube into the inner mixing chamber of the outer tube;

forming at least one ambient air intake port disposed for communication with the inner mixing chamber to enable ambient air, disposed outside the outer tube, to enter into the inner mixing chamber to mix with a flow of forced air and fire retardant for discharge through the outlet port of the outer tube; and extending a flow nozzle through the outer tube of the blower tube assembly, wherein the flow nozzle includes a first end disposed on the outside of the blower tube assembly for connection to a portable reservoir, and a second end disposed within the inner mixing chamber so that liquid fire retardant can flow from the portable reservoir, through the flow nozzle into the inner mixing chamber.

14. A portable fire extinguisher comprising:

portable air means for producing a flow of forced air through an outlet port;

portable reservoir means for storing and supplying a flow of liquid fire retardant;

a blower tube assembly having:

an outer tube that defines an inner mixing chamber disposed adjacent to an outlet port adapted to direct a discharge flow of a mixed air and fire retardant out of the outer tube to extinguish a fire, wherein the inner mixing chamber is adapted for communication with the portable reservoir to enable liquid fire retardant to flow into the inner mixing chamber;

an inner tube defining a blower tube inlet port adapted to receive the outlet port of the portable air means, wherein the inner tube is disposed for communication with the inner mixing chamber to enable a continuous volume of forced air to flow from the air means, through the inner tube into the inner mixing chamber of the outer tube;

at least one ambient air intake port disposed for communication with the inner mixing chamber to enable ambient air, disposed outside the outer tube, to enter into the inner mixing chamber to mix with a flow of forced air and fire retardant for discharge through the outlet port of the outer tube;

at least one spacer support disposed between the outer tube and the inner tube so that the relative position of outer tube from the inner tube is substantially fixed, and wherein the ambient air intake port is defined by a passage formed between the outer tube and the inner tube, adjacent the spacer support.

15. A portable fire extinguisher as recited in claim 14 wherein the portable air means comprises a hand held forced air blower for producing a flow of forced air through an outlet port, and where the portable reservoir means comprises a liquid storage tank arranged to be carried as a back pack on the user's back to supply a flow of liquid fire retardant.

16. A portable fire extinguisher as recited in claim 14 wherein a plurality of spacer supports are employed to fix the inner tube in relation to the outer tube to restrict relative movement, and wherein a plurality of ambient air intake ports are defined by said plurality of spacer supports.

17. A portable fire extinguisher comprising:

portable air means for producing a flow of forced air through an outlet port;

portable reservoir means for storing and supplying a flow of liquid fire retardant;

a blower tube assembly having:

an outer tube that defines an inner mixing chamber disposed adjacent to an outlet port adapted to direct a discharge flow of a mixed air and fire retardant out of the outer tube to extinguish a fire, wherein the inner mixing chamber is adapted for communication with the portable reservoir to enable liquid fire retardant to flow into the inner mixing chamber;

an inner tube defining a blower tube inlet port adapted to receive the outlet port of the portable air means, wherein the inner tube is disposed for communication with the inner mixing chamber to enable a continuous volume of forced air to flow from the air means, through the inner tube into the inner mixing chamber of the outer tube; and at least one ambient air intake port disposed for communication with the inner mixing chamber to enable ambient air, disposed outside the outer tube, to enter into the inner mixing chamber to mix with a flow of forced air and fire retardant for discharge through the outlet port of the outer tube;

wherein the portable air means comprises a hand held forced air blower for producing a flow of forced air through an outlet port, and where the portable reservoir means comprises a liquid storage tank arranged to be carried as a back pack on the user's back to supply a flow of liquid fire retardant; and a flow nozzle extending through the outer tube of the blower tube assembly, wherein the flow nozzle includes a first end disposed on the outside of the blower tube assembly for communication with the portable reservoir means, and a second end disposed within the inner mixing chamber so that liquid fire retardant can flow from the portable reservoir, through the flow nozzle into the inner mixing chamber.

* * * * *